US005694892A

United States Patent [19]

Reatherford

[11] Patent Number: 5,694,892

[45] Date of Patent: Dec. 9, 1997

[54] ROLLER CAMSHAFT FOR INTERNAL COMBUSTION ENGINE

[75] Inventor: Larry V. Reatherford, Clarkston, Mich.

[73] Assignee: Ford Motor Company, Dearborn, Mich.

[21] Appl. No.: 653,038

[22] Filed: May 24, 1996

[51] Int. Cl.[6] ..... F01L 1/04

[52] U.S. Cl. ..... 123/90.6; 123/90.34; 74/567

[58] Field of Search ..... 123/90.17, 90.33, 123/90.34, 90.6; 74/567; 251/251

[56] References Cited

U.S. PATENT DOCUMENTS 4,644,912 2/1987 Umeha t al. ..... 123/90.34

5,161,429 11/1992 Elrod et al. ..... 74/569

5,186,129 2/1993 Magnan et al. ..... 123/90.34

5,253,546 10/1993 Elrod et al. ..... 123/90.6

*Primary Examiner*—Weilun Lo

*Attorney, Agent, or Firm*—Jerome R. Drouillard

[57] ABSTRACT

A roller camshaft for actuating cylinder poppet valves of an internal combustion engine includes a carrier shaft adapted for rotation by an engine crankshaft. The camshaft may be equipped with more than one cam lobe, with each lobe having a base circle portion, an acceleration ramp, a deceleration ramp, a tappet contacting roller housed in a socket positioned at a nose of the lobe, a leading transition ramp located adjacent both the acceleration ramp and the roller, and a trailing transition ramp located adjacent both the deceleration ramp and the roller.

8 Claims, 3 Drawing Sheets

ROLLER CAMSHAFT FOR INTERNAL COMBUSTION ENGINE

BACKGROUND OF THE INVENTION

1. Field of the Invention

The present invention relates to a low friction camshaft having lobes with rollers and bimodal ramps to allow a smooth transition from sliding to rolling contact during operation of the camshaft.

2. Disclosure Information

The friction reducing benefits of rollers in valvetrains are well known. For example, rollers have been used for many years with tappets, such that the roller contacts a cam lobe as used herein, the term "cam follower" means a tappet or other type of valve actuating device for contacting a cam lobe. The use of rollers with direct acting bucket tappets has not, however, been possible because the addition of the roller to the bucket tappet would result in considerable increase in length of the tappet, an increase which cannot be tolerated in an overhead cam engine used for automotive purposes. Previous attempts at rollers, such as that illustrated in U.S. Pat. No. 5,161,429, and which is shown in FIG. 7 of this specification, were not suitable for bucket tappets because such roller camshafts were marked by a discontinuity in the surface presented to the tappet. In other words, as the camshaft rotated with prior art roller nosed lobes, the surface which contacted the finger follower was not a smooth surface; the surface had two regions in which the base lobe and the roller surfaces did not match. As a consequence, such earlier attempts were not suitable for use with direct-acting tappets. This conclusion stems from the consideration that any discontinuous actuation of a valvetrain will result in valve float, sometimes called "toss", and concomitant noise and premature wear.

A camshaft having cam lobes and rollers according to the present invention avoids the bumping problem of the prior art camshaft by allowing the load carried by the cam lobe to be in essence shared between the roller and the leading and trailing transition ramps. The smooth transition from sliding to rolling contact produced with the present invention obviates the bump problem associated with prior art designs by providing a period in which the cam lobe contacts with the tappet with simultaneous sliding and rolling motion.

SUMMARY OF THE INVENTION

A roller camshaft for actuating cylinder poppet valves of an internal combustion engine includes a carrier shaft adapted for rotation by an engine crankshaft and a plurality of cam lobes rigidly attached to the carrier shaft for actuating a plurality of tappets, with each of said lobes comprising a base circle portion, an acceleration ramp, a deceleration ramp, a tappet contacting roller housed in a socket positioned at a nose of the lobe, a leading transition ramp located adjacent both the acceleration ramp and the roller, and a trailing transition ramp located adjacent both the deceleration ramp and the roller.

In a preferred embodiment, cam lobes according to the present invention further comprise an oil passage extending from a location proximate the geometric center of the lobe to the socket in which the roller is mounted, such that a cylindrical surface of the roller is supplied with oil during operation of the engine. According to another aspect of the present invention, the roller is mounted in the socket upon a shaft with sufficient clearance between the roller and the shaft such that the roller will be supported by not only the shaft but also by an oil film extending between the roller and an inner surface of the socket.

The base circle, the acceleration ramp, the leading transition ramp, the roller, the trailing transition ramp, and the deceleration ramp are configured such that during operation of the camshaft, the tappet will first will be contacted sequentially by the base circle singly, then singly by the acceleration ramp, then by both the leading transition ramp and the roller, then singly by the roller, then both by the trailing transition ramp and the roller, then singly by the deceleration ramp.

As used in an engine, a valve system according to the present invention may include a cylinder head and poppet valve slidably mounted within the cylinder head for reciprocating motion therein and having a closed position and an open position, with the valve having a stem situated within a valve guide contained within the cylinder head and a valve head adapted for sealing contact with a cylinder port. A tappet mounted within a bore formed in the cylinder head has a valve contacting surface in contact with an end of the valve stem, and a cam contacting surface adapted for contact with a cam lobe. The cam contacting surface may have a convex configuration. Finally, a camshaft mounted in the cylinder head and having a cam lobe in contact with the cam contacting surface of the tappet includes a base circle portion, acceleration ramp, deceleration ramp, a tappet contacting roller housing in a socket positioned at a nose of the lobe, a leading transition ramp located adjacent both the acceleration ramp and the roller, and a trailing transition ramp located adjacent both the deceleration ramp and the roller.

A cam lobe according to the present invention may be termed as bimodal because during operation of the engine, a portion of the leading transition ramp and the roller will simultaneously contact the cam contacting surface of the tappet. And, at another rotational position of the camshaft, a portion of the trailing transition ramp and the roller will simultaneously contact the roller. In any event, at one rotational position for each cam lobe, the roller will be the only element contacting the tappet.

It is an advantage of the present invention that the power required to drive the camshaft according to the present invention is about 20% less than with a flat tappet configuration and nonroller nose conventional camshaft.

It is another advantage of the present invention that a roller structure according to the present invention requires no additional length in terms of the valvetrain dimensions.

It is yet another advantage of the present invention that the present roller nose camshaft is expected to have a lower noise signature than prior art roller nose camshafts.

DETAILED DESCRIPTION OF PREFERRED EMBODIMENTS

Figure 1:
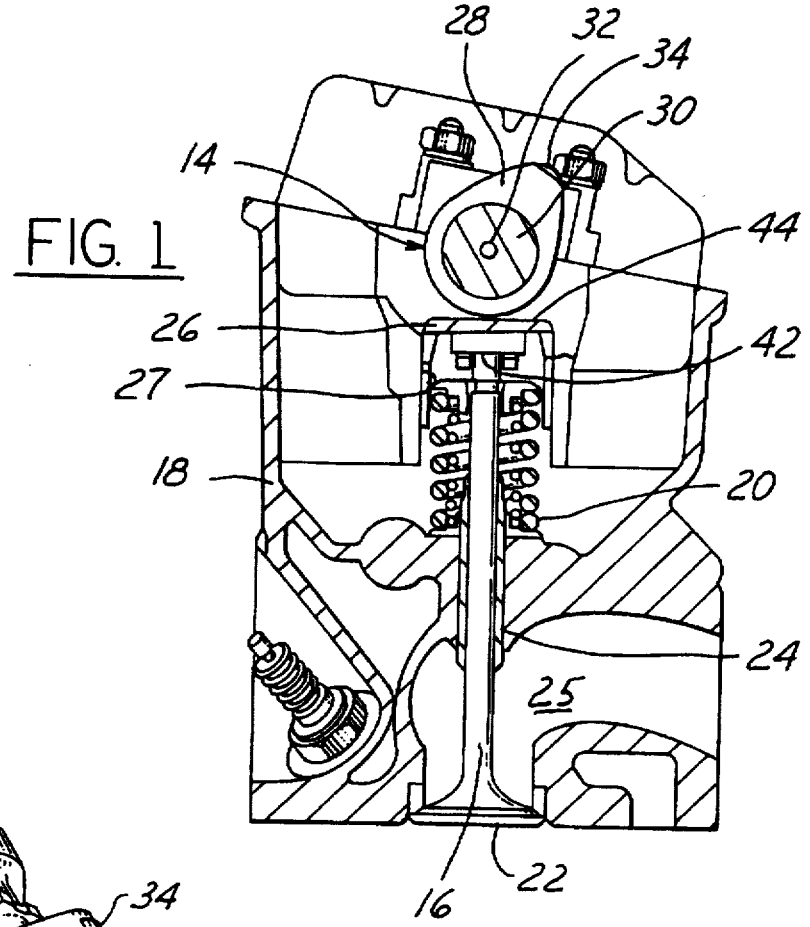
FIG. 1 is a sectional view of an overhead camshaft engine having camshaft lobes equipped with rollers according to the present invention.

As shown in FIG. 1, according to the present invention, engine valve 16 having valve head 22, which controls the flow of gases in port 25, is mounted for reciprocating motion in valve guide 24. Valve spring 20 maintains valve 16 in its closed position whenever valve 16 is not opened by the remaining portion of the valve mechanism.

Valve 16 is operated by tappet 26, which has valve contacting surface 42 and cam contacting surface 44. The latter surface is adapted for contact with cam lobe 28. Tappet 26 is of the so-called "bucket" variety. Tappet 26 rides in tappet bore 27 formed in cylinder head 18. Camshaft 14, as shown in FIG. 1, is of the overhead camshaft variety, in which a plurality of cam lobes 28 act directly upon a plurality of tappets 26 to operate a plurality of valves 16. Those skilled in the art will appreciate, in view of this disclosure, that a system according to the present invention could be employed with either intake or exhaust valves, or both, in either a two or four stroke cycle internal combustion engine.

Figure 2:
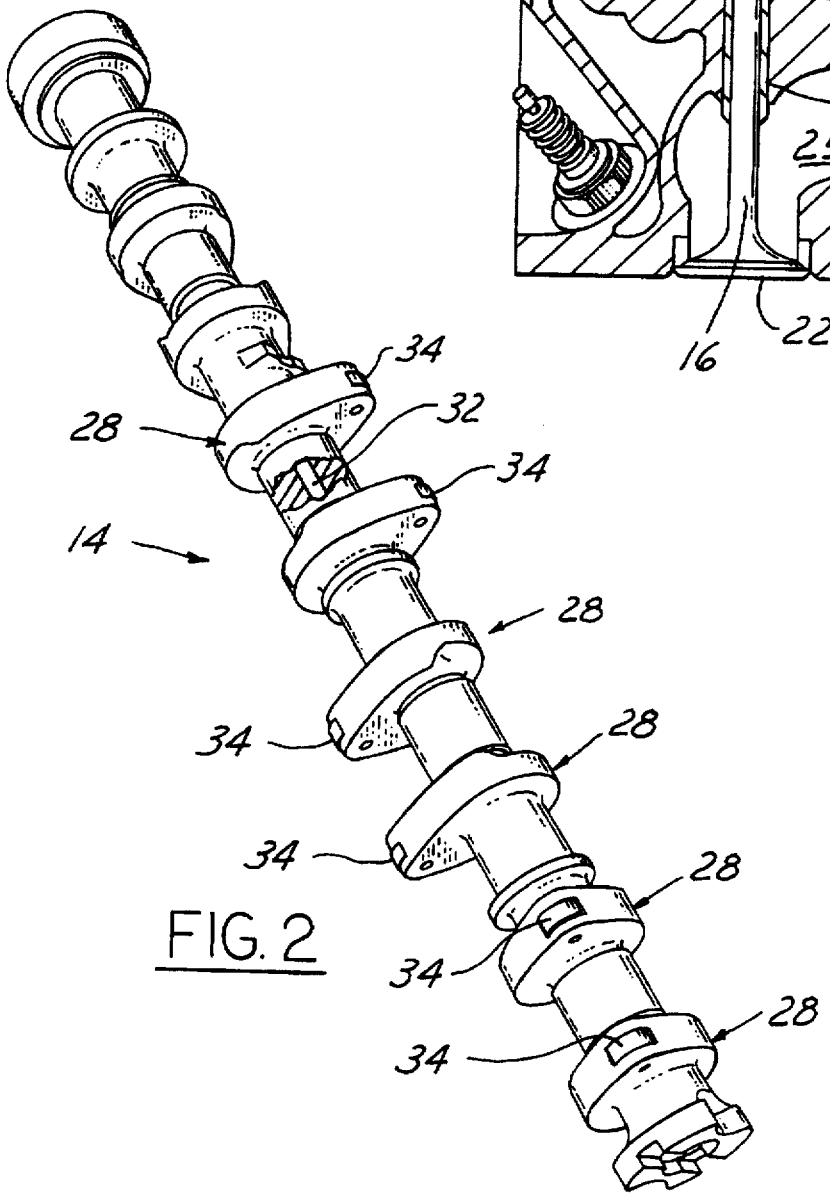
FIG. 2 is a perspective view of a camshaft according to the present invention.

FIG. 2 illustrates camshaft 14, with its eight lobes. Those skilled in the art will further appreciate that a camshaft according to the present invention could be made with any number of lobes, as required by any particular engine to which the present invention is applied. In any event, each of lobes 28 has a construction shown with particularity in FIGS. 3, 4 and 5. Beginning now with FIGS. 3 and 4, each cam lobe 28 has a roller 34 housed in a clevis formed by socket 38, with socket 38 being positioned at the nose, or sharpest portion, of lobe 28. As further shown in FIGS. 3 and 4, each roller 34 is mounted upon a separate shaft 40, with shaft 40 extending through opposing sides of lobe 28. Sufficient clearance is provided between roller 34 and shaft 40, such that roller 34 will be supported by an oil film extending between shaft 40 and roller 34. Additionally, an oil film extending between roller 34 and inner surface 38a of socket 38 will damp radially directed motion of roller 34, thereby reducing the noise signature of a camshaft according to the present invention. The oil film within socket 38 is established by means of oil flowing into socket 38 from oil passage 36. Oil passage 36 extends from a location which although proximate the geometric center of lobe 28, is slightly offset to one side of lobe 28. Oil is supplied to passage 36 by means of a cored or drilled passage 32 (FIGS. 1, 2), which extends axially along the length of camshaft 14 and which is fed oil by means of the camshaft bearings (not shown). The clearance between roller 34 and shaft 40 may be increased to the point where the roller itself is allowed to displace radially, or "cock", so as to accommodate cam lobe profiles which are not cylindrical but rather tapered.

Figure 7:
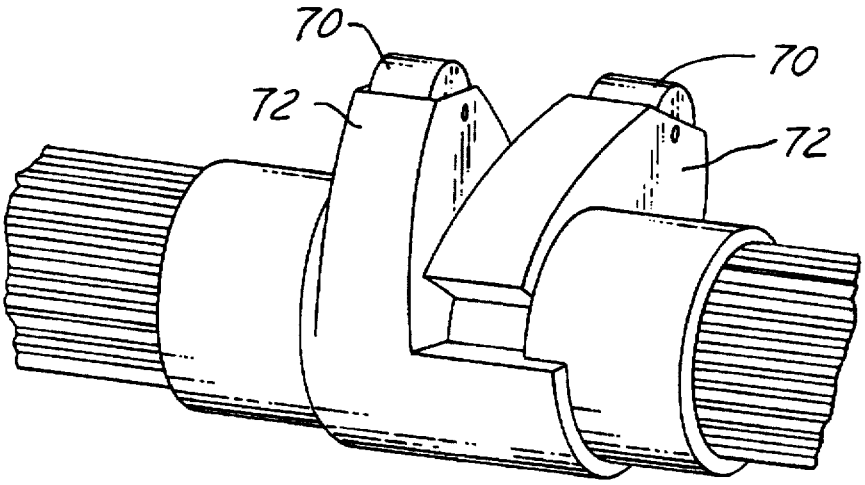
FIG. 7 (PRIOR ART)
FIG. 7 illustrates a prior art roller nose camshaft.

As noted above, the present invention allows a roller nosed camshaft to be used with a flat tappet or tappet having a convex cam contacting surface, without the problems of either excessive noise or bouncing caused by a discontinuity in the cam lobe surface, as shown with the prior art camshaft illustrated in FIG. 7.

Attention is now invited to the camshaft of FIG. 7, wherein rollers 70 and ramps 72 do not present a continuous surface to the cam follower. It is noted in this regard that the disclosure of the '429 patent illustrates a finger follower and not a flat, or bucket tappet. This is because the system of FIG. 7 is not suitable for use with a flat tappet.

Figure 3:
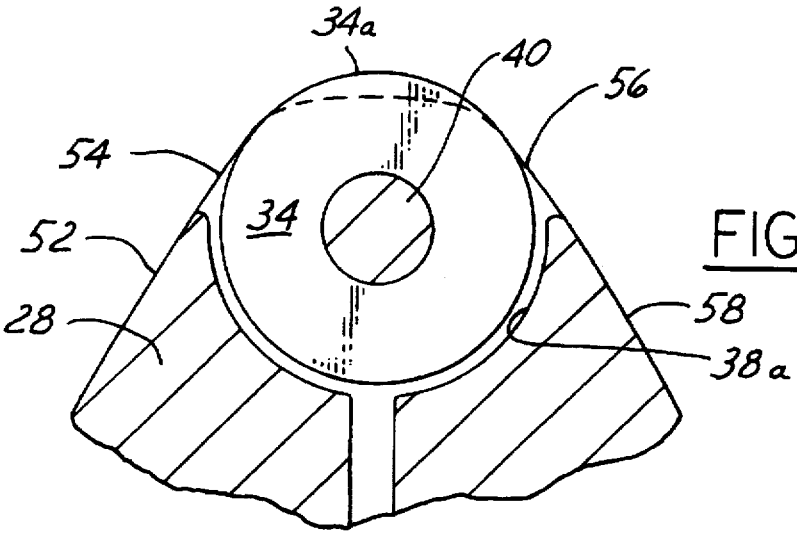
FIG. 3 is an enlarged sectional view of a portion of a camshaft lobe constructed according to the present invention.
Figure 4:
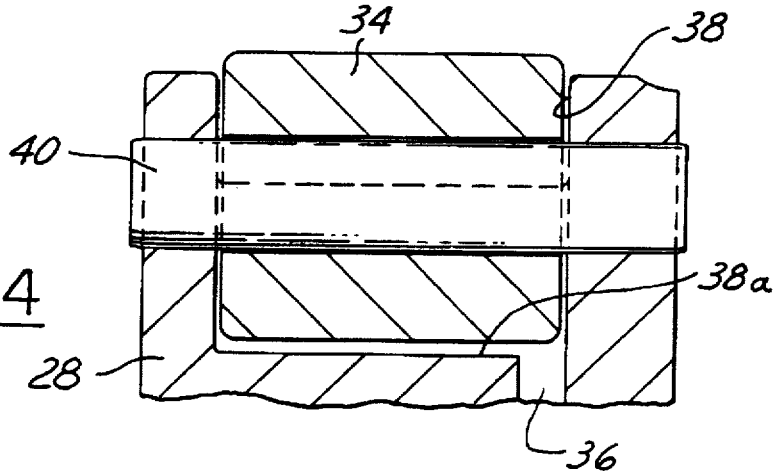
FIG. 4 is a section of a camshaft lobe according to the present invention.
Figure 5:
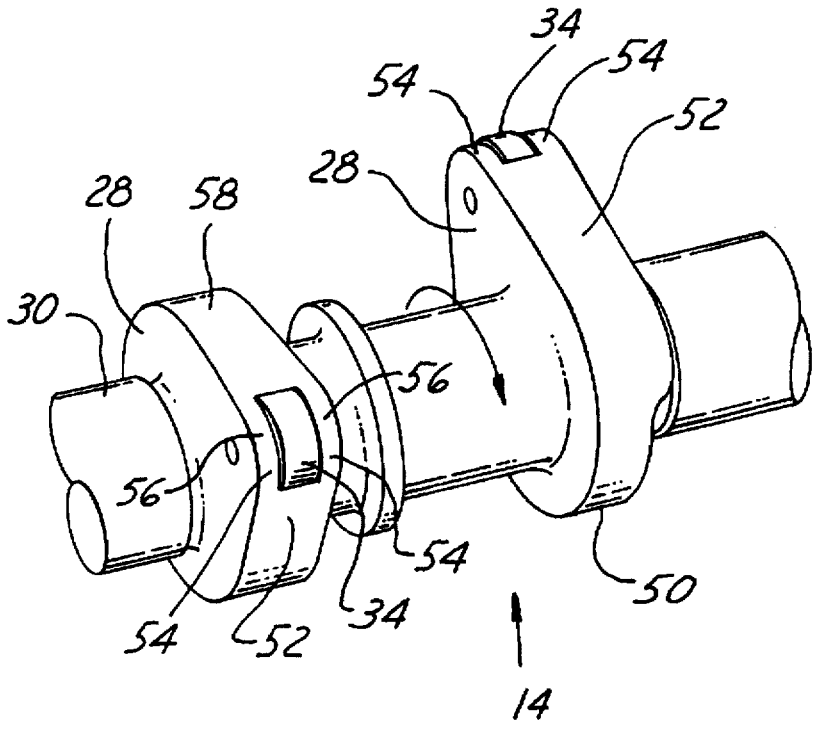
FIG. 5 is an enlarged perspective view of a camshaft according to the present invention.

The present invention works with a flat tappet because as a camshaft 14 rotates in the direction shown in FIG. 5, tappet 26 is first contacted by base circle 50, and then by acceleration ramp 52, wherein valve 16 begins to open. The valve opening task assigned to cam lobe 28 goes through a bimodal transition when leading transition ramp 54, which is shown in FIGS. 3 and 5, begins to be employed. As camshaft 14 rotates and the locus of contact between cam lobe 28 and tappet 26 moves from acceleration ramp 52 to leading transition ramp 54, a rotational position is eventually reached at which acceleration ramp 54 and surface 34a, the outer cylindrical surface of roller 34, are tangent to the same plane. At this precise point, both transition ramp 54 and outer surface 34a of roller 34 will both be contacting tappet 26. In other words, the load will be shared between roller 34 and leading transition ramp 54. Because the load is shared between both leading transition ramp 54 and roller 34, the load imposed by spring 20 will be smoothly accommodated, and this smooth accommodation and concomitant opening of valve 16 will continue through a rotational position at which only surface 34*a* of roller 34 contacts cam contacting surface 44 of tappet 26.

After the point at which only surface 34*a* of roller 34 is singly in contact with tappet 26, a second bimodal transition will occur in which tappet 26 is contacted not only by surface 34*a* of roller 34 but also by trailing transition ramp 56. Thereafter, with continued rotation of camshaft 14, tappet 26 will be contacted singly by deceleration ramp 58, before tappet 26 is contacted solely by base circle 50. It is thus seen that the bifurcated leading and trailing transition ramps, coupled with the fact that roller 34 extends for only about one-half of the axial length of cam lobe 28, allows a smooth, noise-free, shock-free engagement of roller 34 with tappet 26. This periodic and bimodal contact of leading transition ramp 54 and roller 34, followed seriatim by the periodic and simultaneous contact of roller 34 and trailing transition ramp 56, cause a roller camshaft according to the present invention to operate in a much improved fashion over the camshaft illustrated in FIG. 7.

Figure 6:
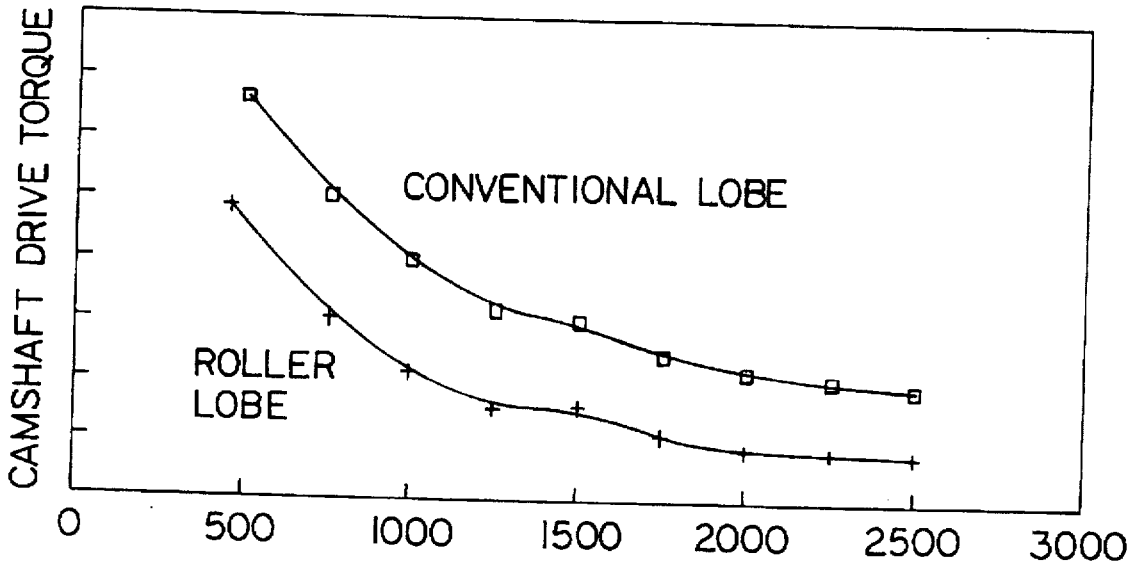
FIG. 6 is a plot illustrating the beneficial reduction in camshaft drive torque produced by a camshaft according to the present invention.

FIG. 6 illustrates merely one benefit of the present invention over a camshaft having conventional lobes for use with flat tappets. In a test of the present device at camshaft speeds from 500–2500 rpm, which correspond to speeds of four-stroke cycle engines from 1000–5000 rpm, it is seen that the drive torque required to power the camshaft 14 was less than that required to power a conventional lobe type of camshaft at every tested speed. Approximately a 20% reduction was noted in the camshaft torque requirement; this torque requirement is directly translatable to a fuel economy benefit.

While the invention has been shown and described in its preferred embodiments, it will be clear to those skilled in the arts to which it pertains that many changes and modifications may be made thereto without departing from the scope of the invention.

I claim:

1. A valve system for an internal combustion engine, comprising:

a cylinder head;

a poppet valve slidably mounted within the cylinder head for reciprocating motion therein and having a closed position and an open position, with said valve having a stem situated within a valve guide, and a valve head adapted for sealing contact with a cylinder port;

a valve spring for urging said valve in its closed position;

a cam follower having a valve contacting surface in contact with an end of said valve stem and a cam contacting surface adapted for contact with a cam lobe; and a camshaft having a cam lobe in contact with said cam contacting surface of said cam follower, with said cam lobe comprising:

a base circle portion;

an acceleration ramp;

a deceleration ramp;

a cam follower contacting roller mounted in a socket positioned at a nose of the lobe;

a leading transition ramp located adjacent both the acceleration ramp and the roller; and a trailing transition ramp located adjacent both the deceleration ramp and the roller, with said leading transition ramp and said trailing transition ramp being positioned such that the cam lobe will contact the cam follower with simultaneous sliding and rolling motion at two rotational positions of the cam lobe.

2. A valve system according to claim 1, wherein each of said cam lobes further comprises an oil passage extending from a location proximate the geometric center of the lobe to the socket in which the roller is mounted, such that a cylindrical surface of the roller is supplied with oil during operation of the engine.

3. A valve system according to claim 2, wherein said roller is mounted in the socket upon a shaft with sufficient clearance between the roller and the shaft, such that the roller will be supported by the shaft, while allowing an oil film extending between the roller and an inner surface of the socket to damp radial motion of the roller.

4. A value system according to claim 1, wherein the base circle, the acceleration ramp, the leading transition ramp, the roller, the trailing transition ramp, and the deceleration ramp are configured such that during operation of the camshaft, the cam follower will first be contacted singly by the base circle, then singly by the acceleration ramp, then by both the leading transition ramp and the roller, then singly by the roller, then by both the trailing transition ramp and the roller, then singly by the deceleration ramp.

5. A valve system according to claim 1, wherein said roller is maintained in said socket by means of a journal shaft mounted in a clevis formed in the nose of the cam lobe.

6. A valve system according to claim 1, wherein said cam lobe is configured such that during operation of the engine, the roller singly contacts the cam contacting surface of the cam follower when the valve is at a position of maximum opening.

7. A valve system according to claim 1, wherein said roller is mounted upon a journal shaft having a principal axis which is parallel to a principal axis of said camshaft, and with the roller having an axial length which approximates one-half the axial length of the cam lobe.

8. A valve system according to claim 7, wherein the leading transition ramp and the trailing transition ramp are each bifurcated and extend from both ends of the roller to the outermost ends of the cam lobe.

* * * * *